United States Patent [19]

Abe

[11] Patent Number: 4,955,294

[45] Date of Patent: Sep. 11, 1990

[54] FOLDABLE TABLE

[75] Inventor: Taizo Abe, Ichikawa, Japan

[73] Assignee: Okamura Corporation, Japan

[21] Appl. No.: 397,580

[22] Filed: Aug. 23, 1989

[30] Foreign Application Priority Data

Dec. 28, 1988 [JP] Japan ..... 63-170335[U]

[51] Int. Cl.[5] ..... A47F 5/12

[52] U.S. Cl. ..... 108/6; 248/371

[58] Field of Search ..... 108/6, 2, 1, 7, 131, 108/132, 133, 134; 248/371, 372.1

[56] References Cited

U.S. PATENT DOCUMENTS

| | | | |
|---|---|---|---|
| 881,501 | 3/1908 | Thompson | 108/1 X |
| 2,030,348 | 2/1936 | Barrett | 108/6 X |
| 3,425,365 | 2/1969 | Thoroson et al. | 108/1 X |
| 3,903,812 | 9/1975 | Cowley | 108/2 |
| 3,933,330 | 1/1976 | Gwin | 248/371 |
| 3,975,050 | 8/1976 | McKee | 248/371 X |

FOREIGN PATENT DOCUMENTS

| | | | |
|---|---|---|---|
| 10474 | 7/1902 | Austria | 248/371 |
| 927767 | 11/1948 | France | 108/2 |
| 2525092 | 10/1983 | France | 248/371 |
| 55-69431 | 5/1980 | Japan . | |
| 57-47933 | 3/1982 | Japan . | |
| 57-72608 | 5/1982 | Japan . | |
| 59-15325 | 1/1984 | Japan . | |
| 59-191936 | 12/1984 | Japan . | |
| 61-207237 | 12/1986 | Japan . | |
| 62-25151 | 6/1987 | Japan . | |

*Primary Examiner*—Jose V. Chen

*Attorney, Agent, or Firm*—Davis, Bujold & Streck

[57] ABSTRACT

A foldable table with a table top adapted to be positioned erect when not in use, and to be set in either a horizontal state or a slightly slanted state. The foldable table comprises on each side thereof a locking mechanism contained within a housing. A first click member, a second click member and a locking disc are rotatably mounted in the locking mechanism, and the locking disc is adapted to be locked by engagement with the first click member and the second click member so that any shaking of the table top in either the horizontal state or the slanted state can be effectively prevented. The table top can be folded by disengaging the first and second click members from the locking disc. The setting or folding operation of the table top is conducted by lifting up the outer end of a lock releasing lever attached to the locking mechanism.

2 Claims, 4 Drawing Sheets

FOLDABLE TABLE

BACKGROUND OF THE INVENTION

This invention relates to a foldable table in which the table top thereof is mounted to a pair of left and right legs in such a way that it can be set upright when not in use.

A foldable table having a structure as mentioned above is known as disclosed in Japanese Utility Model Publication No. 62-25151. In this known foldable table, the table top is provided at the left and right sides thereof respectively with a channel-like frame, which is pivotally fixed to each top end portion of the left and right legs of the table by means of a sporting bolt, the left and right legs being formed of a square pipe. Meanwhile, a lock plate having an engaging recess is pivotally mounted on the upper portions of the left and right legs, and an engaging member which is adapted to be detachably engaged with the engaging recess of the lock plate is fixed to the channel-like frame. The lock plate is secured respectively to the left and right legs via a locking spring. A lock releasing lever is rotatably mounted via its axis to the left and right legs respectively and adapted to be connected with the lock plate. When the engaging recess of the lock plate is engaged with the engaging member, the table top is kept at a horizontal position, rendering it ready for use. On the other hand, when the engaging recess of the lock plate is disengaged from the engaging member by rotating the lock plate by actuating the lock releasing lever, the table top is allowed to stand upright thereby rendering it in a folded state.

With this conventional foldable table, however, since the table top is set in a horizontal state through a detachable engagement of the engaging recess of the lock plate with the engaging member inside the legs, it is rather difficult to prevent the table top from shaking when in use. It may be possible to mount a plurality of the lock plates on each of the left and right legs to engage with the engaging member thereby to prevent the shaking. However, in that case, it is required to assemble the locking components inside the legs, and this makes the assembling operation rather complicated and difficult. It is also impossible with this conventional foldable table to use it in two ways, i.e. use the table top in the horizontal state and in a slanted state wherein the forward side or a side of the table top which faces to a user is lowered.

Moreover, when it is desired to release the engagement of the lock plate, the lock releasing lever is required to be pushed downward to rotate the lock plate thereby disengaging the engaging recess of the lock plate from the engaging member. With this structure, if someone is happened to hang up a heavy bag on the lock releasing lever by the strap attached thereto by mistake, the lock releasing lever may be forced to move downward thereby releasing the engagement of the lock plate and abruptly upsetting the table top while it is being used.

SUMMARY OF THE INVENTION

An object of this invention is to overcome the defects of the conventional foldable table and to provide a novel foldable table whose table top is adapted to be used in two ways, i.e. a horizontal state and a slanted state without causing any shaking of the table top.

Another object of this invention is to provide a foldable table which is safe and neat in structure and can be easily assembled.

Namely, according to this invention, there is provided a foldable table which comprises:

a table top;

a frame member attached respectively to a left side portion and a right side portion of the bottom surface of the table top and having a protruding piece projecting in a direction opposite to the table top;

a lock pin mounted and projecting from the outer wall surface of the protruding piece;

a lock releasing lever rotatably attached to a bottom surface portion of the table top and disposed at an outside of the protruding piece;

a pair of legs, each disposed at a left side and a right side of the table top;

a housing mounted respectively to the top portion of the legs, each having at the bottom end portion thereof a downwardly protruding mounting piece which is fitted in the top portion of the legs;

a pivot pin mounted on and projecting from the upper inner wall surface of the housing, and connected to the protruding piece of the frame member in such a manner as to allow the protruding piece to swing upward and downward;

a first click means rotatably housed in the housing and adapted to be rotated in a direction to release its locking engagement when it is pushed by the lock releasing lever;

a second click means rotatably housed in the housing and adapted to be rotated in a direction to release its locking engagement when it is pushed by the first click means;

a locking disc rotatably housed in the housing and provided with a lock pin-engaging recess adapted to be detachably engaged with the lock pin, with a pair of first engaging recesses adapted to be detachably engaged with the first click means, and with a pair of second engaging recesses adapted to be detachably engaged with the second click means;

a first spring energizing the first click means in a locking direction;

a second spring energizing the second click means in a locking direction;

a lock pin spring energizing the locking disc in a direction to force it to disengage from the lock pin; and a connecting rod connecting the first click means housed in the housing disposed at the left side of the table top with the first click means housed in the housing disposed at the right side of the table top;

wherein a horizontal state of the table top is secured by an engagement respectively of the first and second click means with each one of the first and second engaging recesses, and by a locking action of the lock pin engaged with the lock pin-engaging recess;

a slanted state of the table top is secured by an engagement respectively of the first and second click means with each of the other of the first and second engaging recesses, and by a locking action of the lock pin engaged with the lock pin-engaging recess; and the table top is folded by releasing the engagements of the first and second click means and the lock pin thereby to allowing the table top to erect.

With this foldable table, it has become possible to set the table top in a horizontal state as well as in the slanted state by allowing the first and the second click means to engage respectively with each one of the first and second engaging recesses, or by allowing the first and the second click means to engage respectively with each of the other of the first and second engaging recesses.

Further, it is possible in either states to lock the locking disc at two positions by means of the first and the second click means thereby fully preventing the locking disc from rotating and at the same time allowing the table top to be firmly kept locked without causing the shaking of the table top to occur at all.

Furthermore, since the first and second click means, a locking disc, springs for energizing these components and other main components constituting a locking mechanism can be preliminarily assembled in the housing, and the resultant assembled housing can be fittingly secured to the top portion of the legs, it is possible to easily assemble the table even if the structure is rather complicated. Additionally, since the main components constituting the locking mechanism are covered by the housing, the external appearance of the table as a whole becomes neat.

DETAILED DESCRIPTION OF THE PREFERRED EMBODIMENTS

This invention will be further explained with reference to the drawings.

Figure 1:
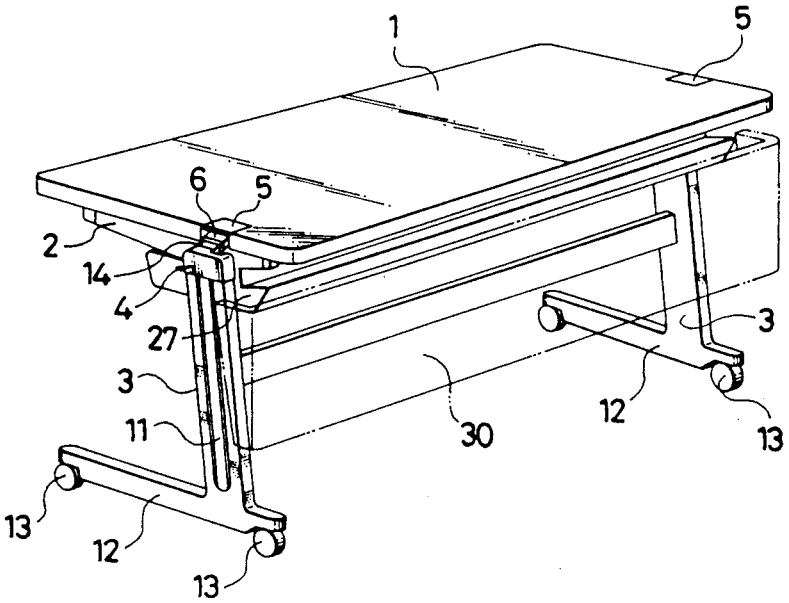
FIG. 1 is a perspective view of a foldable table according to one embodiment of this invention.

Referring to FIG. 1, reference numeral 1 is a table top, and a frame member 2 having a channel-like cross-section is fixed to each of the left side and right side portions of the bottom surface of the table top. The table top 1 is supported by a left leg 3 and a right leg 3, each disposed at the both sides of the table top 1. On each of the top portion of the legs 3 is mounted a locking mechanism 4 as mentioned hereinafter.

Figure 2:
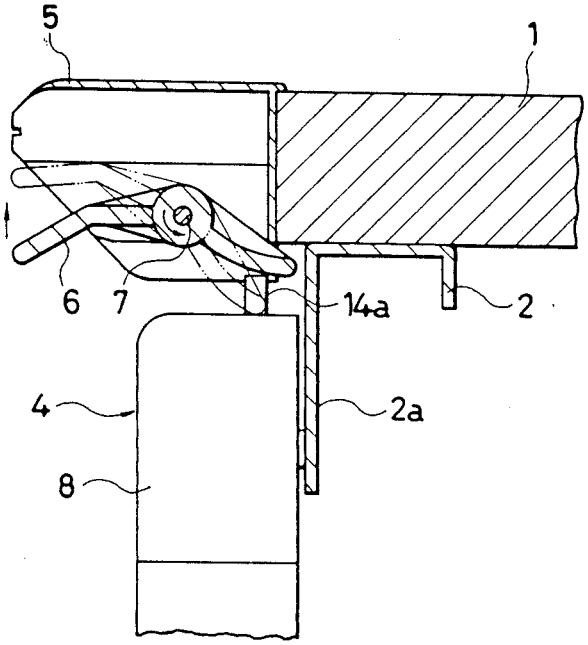
FIG. 2 is an enlarged sectional view showing a lock releasing lever.
Figure 3:
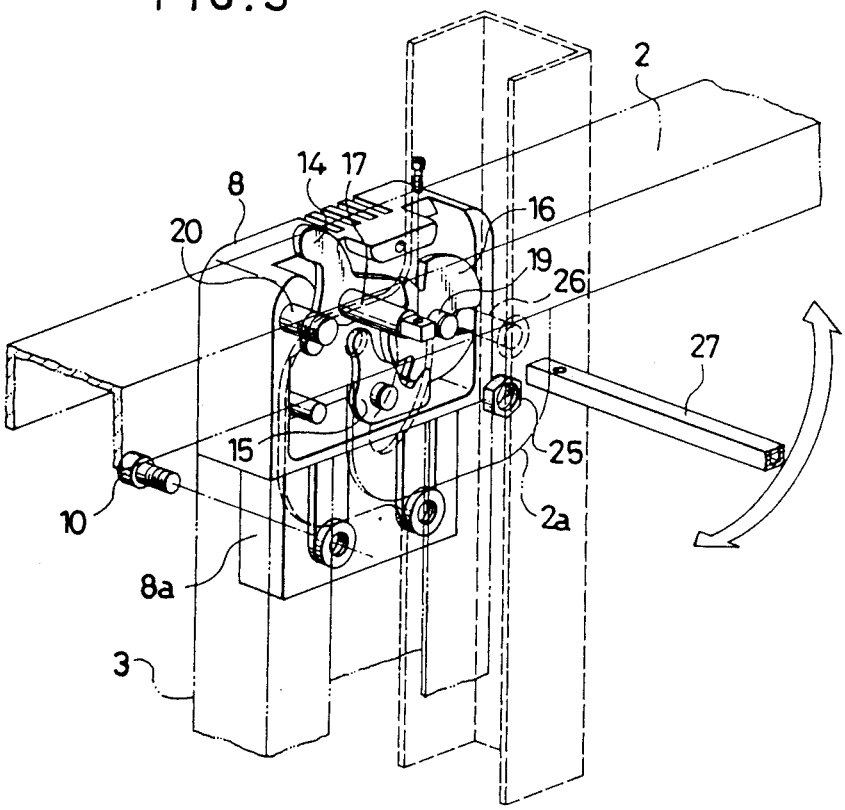
FIG. 3 is a perspective view showing a partially disassembled state of the locking mechanism.

On a portion of each of the left and right sides of the table top 1, which faces to the locking mechanism 4, is fixed as shown in FIGS. 1 and 2 a mounting member 5 formed of a molded synthetic resin product. A lock releasing lever 6 is pivotally attached via a horizontal axis 7 to the bottom portion of the mounting member 5 so that the lock releasing lever 6 can be swung upward or downward. This lock releasing lever 6 is constructed in such a manner that the outer portion extending from the axis 7 is formed longer than the inner portion extending from the axis 7, so that the inner portion of the lock releasing lever 6 is always energized to move toward the bottom portion of the table top due to the relatively heavier weight of the outer portion.

The locking mechanism 4 comprises as shown in FIGS. 1 to 5 a housing 8 having an open inner side and a mounting piece 8*a* extending downward from the bottom of the housing 8. The housing 8 and the mounting piece 8*a* are integrally molded by using as a raw material a synthetic resin or a metal. The mounting piece 8*a* is fitted in the top portion of the leg 3 having a channel-like cross-section. To be more specific, the mounting piece 8*a* is sustained on the supporting member 9 fitted in the upper portion of the leg 3 and is fixed to the leg 3 by means of screws 10 which are disposed from the opening 3*a* provided in the outer side wall of the leg 3. The top surface of the leg 3 is covered by the bottom surface of the housing 8, whereas the opening 3*a* of the leg 3 is covered by a leg-covering member 11 made of a molded synthetic resin product. ON the back surface of the leg-covering member 11 is projected a pair of parallel ribs 11*a* which are forcedly inserted into the opening 3*a* of the leg 3. The leg-covering member 11 is sustained inside the leg 3 by being pressed toward the inner wall of the leg 3 due to its resilient restoration force.

At the lower end portion of the leg 3 is integrally attached a horizontal leg 12 extending back and forth. The horizontal leg 12 is provided at the both ends thereof with a pair of castors. Inside the housing 8 are housed a first click means 14, a second click means 15 and a locking disc 16 which are pivotally mounted by means of horizontal axes 17, 18 and 19 respectively. On the upper corner of the inner wall of the housing 8 is projected a horizontal pivot pin 20 projecting in perpendicular to the inner wall. The first click means 14 comprises a first click 14*a*, a second click 14*b* and a third click 14*c*, each radially projecting from the axis 17. A portion of the first click 14*a* is adapted to extend beyond the top end portion of the housing 8, and to be contacted by the inner portion of the lock releasing lever 6. The second click 14*b* extends toward the locking disc 16, and the third click 14*c* extends toward the second click means 15 to such an extent that the third click 14*c* can be contacted by a first click 15*a* of the second click means 15. A second click 15*b* of the second click means 15 extends toward the locking disc 16 having engaging recesses 16*a*, 16*b*, 16*c*, 16*d* and 16*e*. Among them, engaging recesses 16*a* and 16*b* which are adapted to be engaged with the second click 14*b* are disposed adjacent to each other, and engaging recesses 16*c* and 16*d* which are adapted to be engaged with the second click 15*b* are disposed adjacent to each other.

Figure 6:
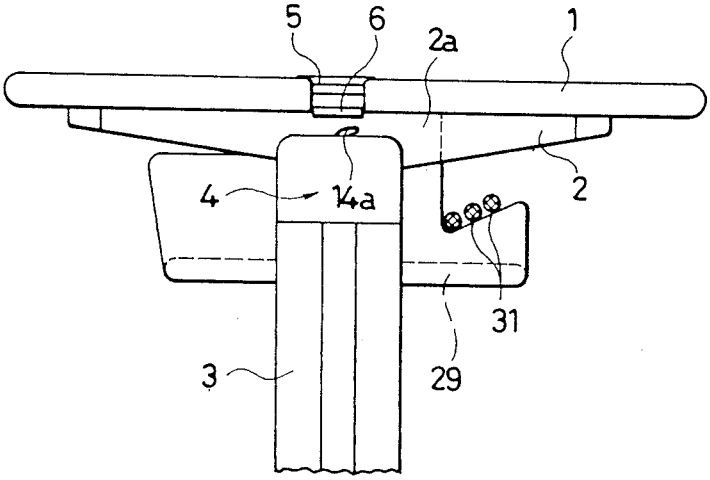
FIG. 6 is a side view of the upper portion of the table according to another embodiment of this invention.
Figure 4:
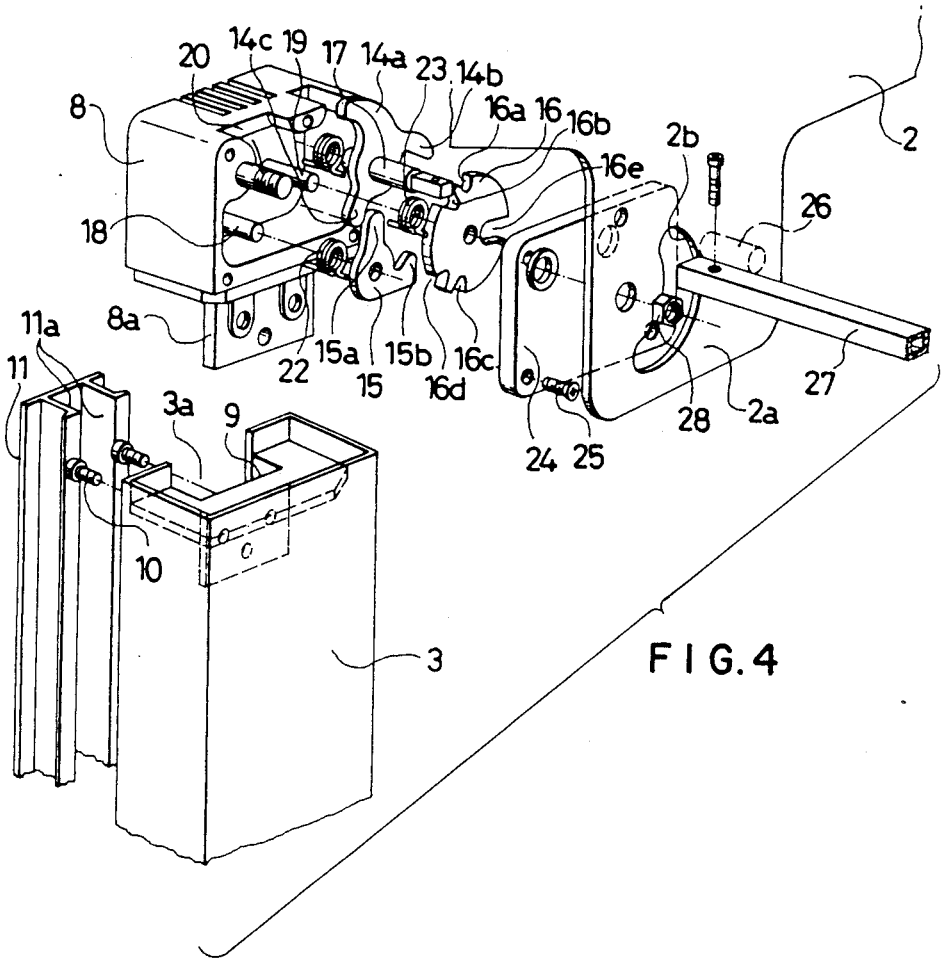
FIG. 4 is a disassembled perspective view of the locking mechanism.
Figure 5A:
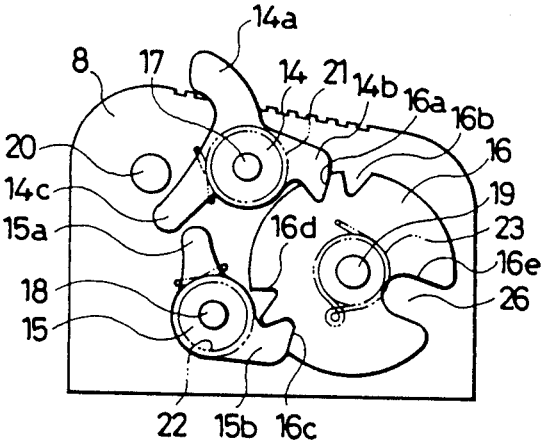
FIGS. 5(*a*), 5(*b*) and 5(*c*) are side views explaining the operation of the locking mechanism.
Figure 5B:
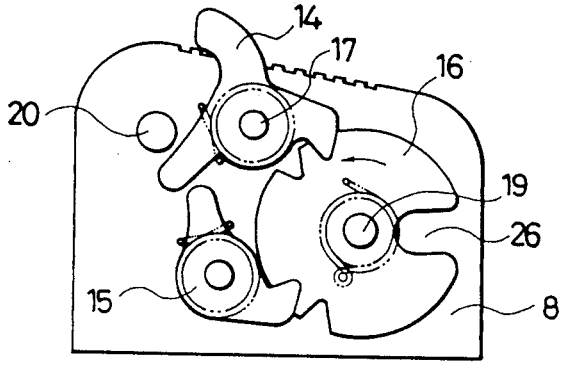
Figure 5C:
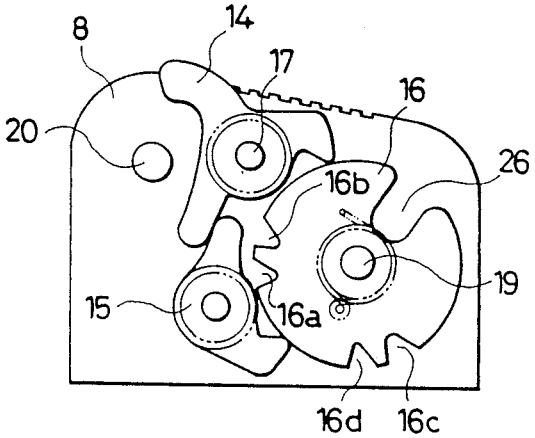

The first click means 14 and the second click means 15 mounted within the housing 8 are respectively energized by a first spring 21 and a second spring 22 to rotate clockwise and counter-clockwise respectively in FIGS. 4 and 5. Meanwhile, the locking disc 16 is energized by a lock spring 23 to rotate counter-clockwise in FIGS. 4 and 5. A covering plate 24 is detachably fixed to the inner wall of the housing to cover the opening of the housing 8. The pivot pin 20 as well as the axis 17 of the first click means 14 protrudes through the pores provided in the covering plate 24. On the pivot pin 20 is rotatably supported the protruding piece 2*a* attached to the frame member 2. The axis 17 of the first click means 14 protrudes through an arcuate hole 2*b* provided in the protruding piece 2*a* and is projected from the protrudeing piece 2*a*. The axis 17 of the first click means 14 in each of the left and right locking mechanisms 4 are connected or interlocked to each other by means of a connecting rod 27. On the outer wall of the protruding piece 2*a* is mounted a lock pin 26 projecting therefrom. The lock pin 26 is adapted to detachably engage with the engaging recess 16*e* of the locking disc 16. The arcuate hole 2*b* provided in the protruding piece 2*a* is formed in a circular shape around the pivot pin 20. The reference numeral 28 shown in FIGS. 3 and 4 indicates a nut to be fitted on the pivot pin 20. In FIG. 6, reference numeral 29 is a shelf attached to the bottom surface of the table top 1, and 30 indicates a covering plate whose both ends are secured to the left and right legs 3.

The operation of the foldable table as constructed above will now be explained below.

When the table top 1 is in a usage status as shown in FIG. 5(*a*), the second click 14*b* of the first click means 14 and the second click 15*b* of the second click means 15 are respectively engaged with the engaging recess 16*a* and the engaging recess 16*c* of the locking disc 16, and the first and second click means 14 and 15 are so energized by means of the first and second springs as to force the second click 14*b* and the second click 15*b* to approach to each other. At the same time, the lock pin 26 mounted on the protruding piece 2*a* of the frame member 2 is engaged with the engaging recess 16*e* of the locking disc 16 so as to prevent the locking disc 16 from rotating. Accordingly, the table top 1 is kept in a horizontal state and locked.

In this state, when the outer portion of the lock releasing lever 6 is lifted, the lock releasing lever 6 is rotated around the axis 7 clockwise in FIG. 2 to lower the inner portion of the lock releasing lever 6. As a result, the inner portion of the lock releasing lever 6 pushes downward the first click 14*a* which has been projected over the housing 8, thereby causing the first click means 14 to rotate counter-clockwise in resistance to the resilient force of the spring 21. This in turn causes the third click 14*c* of the first click means 14 to push the first click 15*a* of the second click means 15, and to rotate the second click means 15 clockwise in resistance to the resilient force of the spring 22. As a result, the second click 14*b* and the second click 15*b* of the first and second click means 14 and 15 are disengaged from the engaging recesses 16*a* and 16*c* of the locking disc 16, and the locking disc 16 is forced to rotate counter-clockwise due to the resilient force of the spring 23. At the same time, the table top 1 is forced to rotate via the frame member 2 around the pivot pin 20.

When the lifting of the lock releasing lever 6 is stopped immediately after slightly lifting the lock releasing lever 6, the second click 14*b* and the second click 15*b* of the first and second click means 14 and 15 are engaged respectively with the engaging recesses 16*b* and 16*d* of the locking disc 16 as shown in FIG. 5(*b*). In this case, the engaging recess 16*e* is shifted upward while maintaining the engagement of the lock pin 26 with the engaging recess 16*e* of the locking disc 16. As a result, the frame member 2 and the table top 1 are turned into a slanted state with the forward side thereof being slightly lowered, and kept locked at this slanted position. In this case, the angle of the inclination of the table top is generally set at 5° in respect to the horizon. However, the inclination angle may be changed by adjusting the distances between the engaging recess 16*a* and 16*b*, as well as between the engaging recess 16*c* and 16*d* while maintaining the both distances equal.

Either in the horizontal state of the table top as shown in FIG. 5(*a*), and when the outer portion of the lock releasing lever 7 is lifted for somewhat longer period of time, or in the slanted state as shown in FIG. 5(*b*), and when the outer portion of the lock releasing lever 7 is lifted, the locking disc 16 is rotated further without causing the engaging recesses 16*a*, 16*b*, 16*c* and 16*d* to be engaged with any of the second click 14*b* and the second click 15*b* of the first and second click means 14 and 15. In this case, the second click 14*b* and the second click 15*b* are merely contacted to the outer periphery of the locking disc 16, and the lock pin 26 mounted to the frame member 2 is disengaged from the engaging recess 16*e* of the locking disc 16 as shown in FIG. 5(*c*). Accordingly, the table top 1 as well as the frame member 2 is free to rotate around the pivot pin 20, thereby rendering the table top 1 to be ready for folding in an upright state.

When the table top 1, which is in the folded state, is turned around the pivot pin 20 to make the table top 1 approximately horizontal, the locking disc 16 is forced to rotate clockwise in resistance to the resilient force of the spring 23 and the lock pin 26 is caused to engage with the engaging recess 16*e* of the locking disc 16, so that the second click 14*b* and the second click 15*b* of the first and second click means 14 and 15 can be engaged either with the engaging recesses 16*a* and 16*c* or with the engaging recesses 16*b* and 16*d* of the locking disc 16, thereby causing the table top 1 to take the horizontal or the inclined position.

Since both of the first click means 14 provided in the left and right locking mechanisms 4 are connected and interlocked to each other by means of the connecting rod 27, when either one of the lock releasing levers 6 disposed at left and right sides of the table top 1 is operated, or when the returning operation of the table top 1 from its folded state is conducted, each components in both of the left and right locking mechanisms 4 can be actuated simultaneously with each other.

With the foldable table of this invention, it is possible to dispose an electric wire cord 31 on the shelf fixed to the bottom surface of the table top 1 as shown in FIG. 6, it is no more required to use additional parts for disposing the wire cord 31, so that lighting fittings can be conveniently mounted thereon.

The foldable table of this invention as explained above can be modified in various ways. For example, the lock releasing lever may be energized by disposing a spring thereto to energize the inner portion of the lock releasing lever toward the upper surface of the table top. The covering plate of the locking mechanism can be dispensed with. However, it is preferable to employ the covering plate to fix or support protruding ends of the pins or shafts fixed or supported on the wall of the housing.

Since the mounting member 5, the housing for the locking mechanism 4 and the leg cover 11 are formed of a molded synthetic resin product or a metallic cast product as explained above, the outer appearance of the foldable table can be made beautiful by putting a suitable color thereon.

Moreover, since the lock-releasing operation of the locking mechanism 4 is conducted by lifting up the outer portion of the lock releasing lever 6, the release of the lock would never be happened to occur even if someone hangs up a heavy bag on the lock releasing lever by the strap attached thereto by mistake, so that any accident that the table top is abruptly upset to turn into the folded state while it is in use can be effectively avoided.

What we claim is:

1. A foldable table comprising:

a table top;

a frame member attached respectively to opposed side portions of a bottom surface of the table top and having a protruding piece adjacent each side portion projecting in a direction opposite to the table top;

a lock pin mounted on and projecting from an outer wall surface of each protruding piece;

a lock releasing lever rotatably attached to a bottom surface of the table top and disposed adjacent one of the protruding pieces;

a pair of legs, one being located adjacent each protruding piece;

a housing mounted on a top portion of each of the legs, each housing having a pivot pin projecting from an inner wall surface thereof and connected with the protruding piece of the frame member adjacent thereto in such a manner as to allow the protruding pieces to pivot about the pivot pins;

first click means rotatably housed within each housing and being adapted to be rotated in a direction to release a locking engagement when it is engaged by the lock releasing lever;

a first spring means energizing the first click means in a locking direction;

second click means rotatably housed in each housing and being adapted to be rotated in a direction to release a locking engagement when it is engaged by the first click means;

a second spring means energizing the second click means in a locking direction;

a locking disc rotatably housed in each housing and provided with a lock pin-engaging recess adapted to be detachable engaged with the lock pin, a pair of first engaging recesses adapted to be detachably engaged with the first click means to provide the locking engagement of the first click means, and a pair of second engaging recesses adapted to be detachably engaged with the second click means to provide the locking engagement of the second click means, the lock pin-engaging recess, the pair of first engaging recesses and the pair of second engaging recesses being located about the periphery of the locking disc for engagement with the first click means, the second click means and the locking pin, respectively;

a lock pin spring means energizing the locking disc in a direction to force it to disengage from the lock pin; and connecting means interconnecting the first click means housed within each housing;

wherein a horizontal state of the table top is secured by engagement of the first and second click means with a first recess of the pair of first and second engaging recesses, respectively, and by a locking action of the lock pin engaged with the lock pin-engaging recess;

a slanted state of the table top is secured by engagement of the first and second click means with a second recess of the pair of the first and second engaging recesses, respectively, and by a locking action of the lock pin engaged with the lock pin-engaging recess; and the table top is folded by releasing the locking engagement of the first and the second click means with the pair of first and second engaging recesses, respectively, thereby allowing the table top to be pivoted about the pivot pins to an erect position.

2. A foldable table according to claim 1, wherein said first click means comprises first, second and third click members extending radially from a rotational axis of the first click means, wherein the first click member is adapted to engage said locking disc, the second click member is adapted to be pushed by said lock releasing lever, and the third click member is adapted to engage said second click means.

* * * * *